US005765530A

United States Patent [19]

Machida et al.

[11] Patent Number: 5,765,530

[45] Date of Patent: Jun. 16, 1998

[54] METHOD OF CONTROLLING IGNITION TIMING OF INTERNAL COMBUSTION ENGINE AND APPARATUS THEREFORE

[75] Inventors: Kenichi Machida; Hirokazu Shimizu, both of Atsugi, Japan

[73] Assignee: Unisia Jecs Corporation, Kanagawa-ken, Japan

[21] Appl. No.: 775,767

[22] Filed: Dec. 31, 1996

[30] Foreign Application Priority Data

Jan. 8, 1996 [JP] Japan ..... 8-000657

[51] Int. Cl.[6] ..... F02P 5/00

[52] U.S. Cl. ..... 123/419; 123/425

[58] Field of Search ..... 123/419, 425

[56] References Cited

U.S. PATENT DOCUMENTS 4,860,711 8/1989 Morikawa ..... 123/48 D
5,090,383 2/1992 Demizu et al. ..... 123/425
5,101,788 4/1992 Demizu et al. ..... 123/425
5,107,813 4/1992 Inoue et al. ..... 123/425

FOREIGN PATENT DOCUMENTS 63-17432 2/1988 Japan .

*Primary Examiner*—Tony M. Argenbright
*Assistant Examiner*—Hieu T. Vo
*Attorney, Agent, or Firm*—McDermott, Will & Emery

[57] ABSTRACT

The heat generating ratio for every crank angle is calculated as a combustion ratio for the total amount of heat generated by the engine, and the ignition timing is so corrected that the crank angle corresponding to from 10% to 90% of the combustion ratio becomes minimal or is so corrected that the combustion ratio at a predetermined crank angle becomes equal to or larger than a predetermined value. This makes it possible to so control the ignition timing that the engine produces a maximum torque.

13 Claims, 6 Drawing Sheets

CYLINDER PRESSURE
TDC

HEAT GENERATING RATIO

COMBUSTION RATIO
90
10
θMB10-90

METHOD OF CONTROLLING IGNITION TIMING OF INTERNAL COMBUSTION ENGINE AND APPARATUS THEREFORE

BACKGROUND OF THE INVENTION

1. Field of the Invention

The present invention relates to a method of controlling the ignition timing of an internal combustion engine and an apparatus therefore. More specifically, the invention relates to technology for so controlling the ignition timing to obtain a maximum torque of an internal combustion engine.

2. Related Art of the Invention

It has heretofore been attempted to so control the ignition timing to obtain a maximum torque of an engine by delaying or advancing the ignition timing in a manner that the cylinder pressure of the engine becomes maximal at a preset crank angle.

In order to precisely detect the crank angle at which the cylinder pressure becomes maximal, however, the cylinder pressure must be sampled at each small crank angle, making it necessary to employ a crank angle sensor capable of detecting a small angle and an A/D converter having a short sampling period.

Here, a high-precision crank angle sensor and an A/D converter having a short sampling period are not required if the interval for sampling the cylinder pressure is lengthened, a change in the cylinder pressure is interpolation operated from the cylinder pressure detected at a plurality of crank angles and the crank angle at which the cylinder pressure becomes maximal is estimated from the results of interpolation operation. However, a required precision is not obtained from the estimation based upon the interpolation operation.

SUMMARY OF THE INVENTION

The present invention was accomplished in view of the above-mentioned problems and its object is to provide a method of controlling the ignition timing to obtain accurately a maximum torque of an engine with a simple constitution, and an apparatus therefore.

According to the method and apparatus for controlling the ignition timing of an internal combustion engine of the present invention for accomplishing the above-mentioned object, the cylinder pressure of the engine is detected, a value corresponding to an indicated mean effective pressure is calculated based upon the detected cylinder pressure, and the ignition timing is delayed or advanced so that the indicated mean effective pressure becomes maximal.

According to this constitution, a value corresponding to the indicated mean effective pressure is calculated based upon the cylinder pressure detected at each of a plurality of crank angles, the ignition timing is advanced while the indicated mean effective pressure is increasing so that the indicated mean effective pressure becomes maximal, and the ignition timing is delayed when the indicated mean effective pressure starts decreasing. The indicated mean effective pressure is a value approximately in proportion to the output torque of the engine. The ignition timing is controlled so that the indicated mean effective pressure becomes maximal, thereby controlling the output torque of the engine to a maximum.

Moreover, constitution may be such that the cylinder pressure of the engine is detected, the combustion ratio of the engine is calculated based upon the detected cylinder pressure, and the ignition timing is delayed or advanced so that characteristics of a change in the combustion ratio comply with a target state.

According to this constitution, the ignition timing is delayed or advanced so that a change in the combustion ratio of the engine represents a target change enabling the engine to produce a maximum torque.

Here, the combustion ratio can be calculated as a heat generating ratio for every crank angle with respect to the total amount of heat generated.

Moreover, it is preferable that the ignition timing is so delayed or advanced that a crank angle corresponding to a predetermined range of the combustion ratio becomes minimal.

For instance, the ignition timing is advanced while the crank angle corresponding to a range of combustion ratios of from 10% to 90% decreasingly changes, and the ignition timing is delayed when the above crank angle starts increasing, so that the combustion takes place in a concentrated manner within narrow crank angles.

Furthermore, the ignition timing may be delayed or advanced so that the combustion ratio at a preset crank angle becomes equal to or larger than a target value.

In this constitution, the ignition timing is advanced while the combustion ratio at a preset crank angle is increasing in a range smaller than a target value, and the ignition timing is delayed while the combustion ratio is decreasing, so that the combustion ratio at the preset crank angle becomes equal to or greater than the target value, making the combustion ratio proceed rapidly to produce a maximum torque.

Other objects and features of the invention will become obvious from the following description of embodiments in conjunction with the accompanying drawings

PREFERRED EMBODIMENTS

Embodiments of the method and apparatus for controlling the ignition timing of an internal combustion engine according to the present invention will now be described with reference to the drawings.

Figure 1:
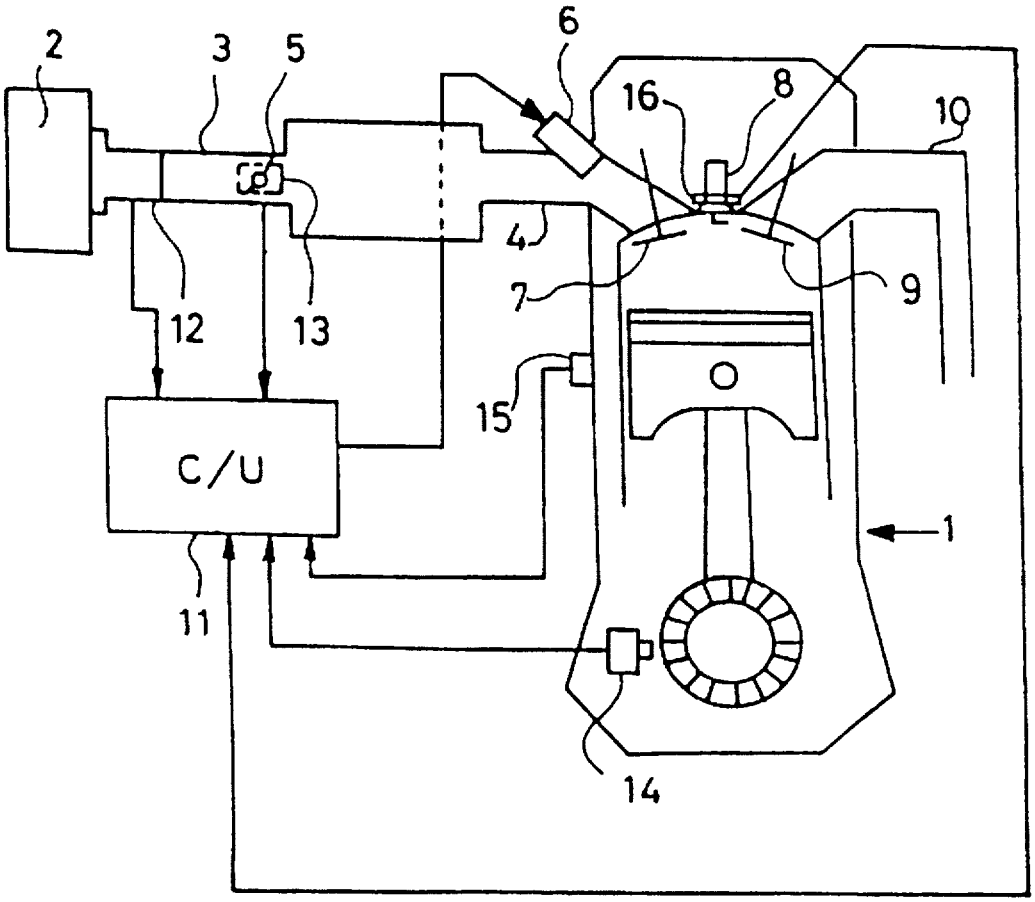
FIG. 1 is a system diagram of an internal combustion engine to which are applied a method and an apparatus for controlling the ignition timing of an internal combustion engine according to the present invention.

FIG. 1 is a diagram illustrating a system constitution according to an embodiment, wherein an internal combustion engine 1 intakes air through an air cleaner 2, an intake duct 3, and an intake manifold 4.

The intake duct 3 is equipped with a butterfly-type throttle valve 5 interlocked to an accelerator pedal that is not shown, and the amount of the engine intake air is adjusted by the throttle valve 5.

Each branch portion of the intake manifold 4 is provided with an electromagnetic fuel injection valve 6 for each of the cylinders, and a mixture gas of a target air-fuel ratio is formed by electronically controlling the fuel amount injected from the fuel injection valve 6.

The mixture air intaken by the cylinder through an intake valve 7 burns with a spark produced by an ignition plug 8 provided for each of the cylinders, and the combustion exhaust gas is discharged through an exhaust valve 9 and is guided through an exhaust manifold 10 to a catalytic converter and a muffler that are not shown.

A control unit 11 for controlling the fuel injection amount through the fuel injection valve 6 and the ignition timing at the ignition plug 8 is constituted by a microcomputer and receives an intake air amount signal Q from a hot-wire type air flow meter 12, a throttle valve opening degree signal TVO from a throttle sensor 13, a crank angle signal from a crank angle sensor 14, a cooling water temperature signal Tw from a water temperature sensor 15, a cylinder pressure signal P from a cylinder pressure sensor 16 and like signals.

The hot-wire type air flow meter 12 directly detects the air intake amount of the engine 1 as a mass flow rate based upon a change in resistance of a temperature sensitive resistor that changes depending upon the intake air amount.

The throttle sensor 13 detects the opening degree TVO of the throttle valve 5 by means of a potentiometer.

The crank angle sensor 14 outputs a unit angle signal for every unit crank angle and a reference angle signal for every predetermined piston position. The rotational speed Ne of the engine can be calculated by measuring the number of the unit angle signals generated within a predetermined period of time or by measuring the period of generating the reference angle signal.

The water temperature sensor 15 detects the cooling water temperature Tw in the water jacket of the engine 1 as a temperature representing the engine temperature.

The cylinder pressure sensor 16 (means for detecting cylinder pressure) is a ring-like piezoelectric element fitted as washer to the ignition plug 8 as disclosed in Japanese Unexamined Utility Model Publication No. 63-17432, and detects the cylinder pressure as a relative pressure to the tightening load of the ignition plug. The cylinder pressure sensor 16 may be of the type that is fitted as a washer to the ignition plug 8 as mentioned above, or may be of the type in which the sensor unit is directly faced into the combustion chamber to detect the cylinder pressure as an absolute pressure.

The control unit 11 determines a basic ignition timing relying upon the operation conditions of the engine such as engine load, rotational speed of the engine, etc., and controls the ignition timing at the ignition plug 8.

The injection amount of the fuel injection valve 6 is controlled by the control unit 11 in a manner as described below.

A basic fuel injection amount Tp (=K×Q/Ne, K is a constant) corresponding to a target air-fuel ratio is calculated based upon the intake air amount Q detected by the hot-wire type air flow meter 12 and the engine rotational speed Ne calculated from the detection signal of the crank angle sensor 14. The basic fuel injection amount Tp is corrected corresponding to the operation conditions such as cooling water temperature Tw and the like to find a final fuel injection amount Ti. A drive pulse signal of a width corresponding to the fuel injection amount Ti is output at a predetermined timing to the fuel injection valve 6. The fuel injection valve 6 is supplied with a fuel of which the pressure is adjusted to a predetermined pressure by a pressure regulator that is not shown, and the fuel amount proportional to the width of the drive pulse signal is injected to form a mixture gas of a desired air-fuel ratio.

Based upon the detection signal from the cylinder pressure sensor 16, the control unit 11 delays or advances the basic ignition timing in a manner as will be described later in order to set a final ignition timing and to control the ignition timing at the ignition plug 8 relying upon the above ignition timing.

Figure 2:
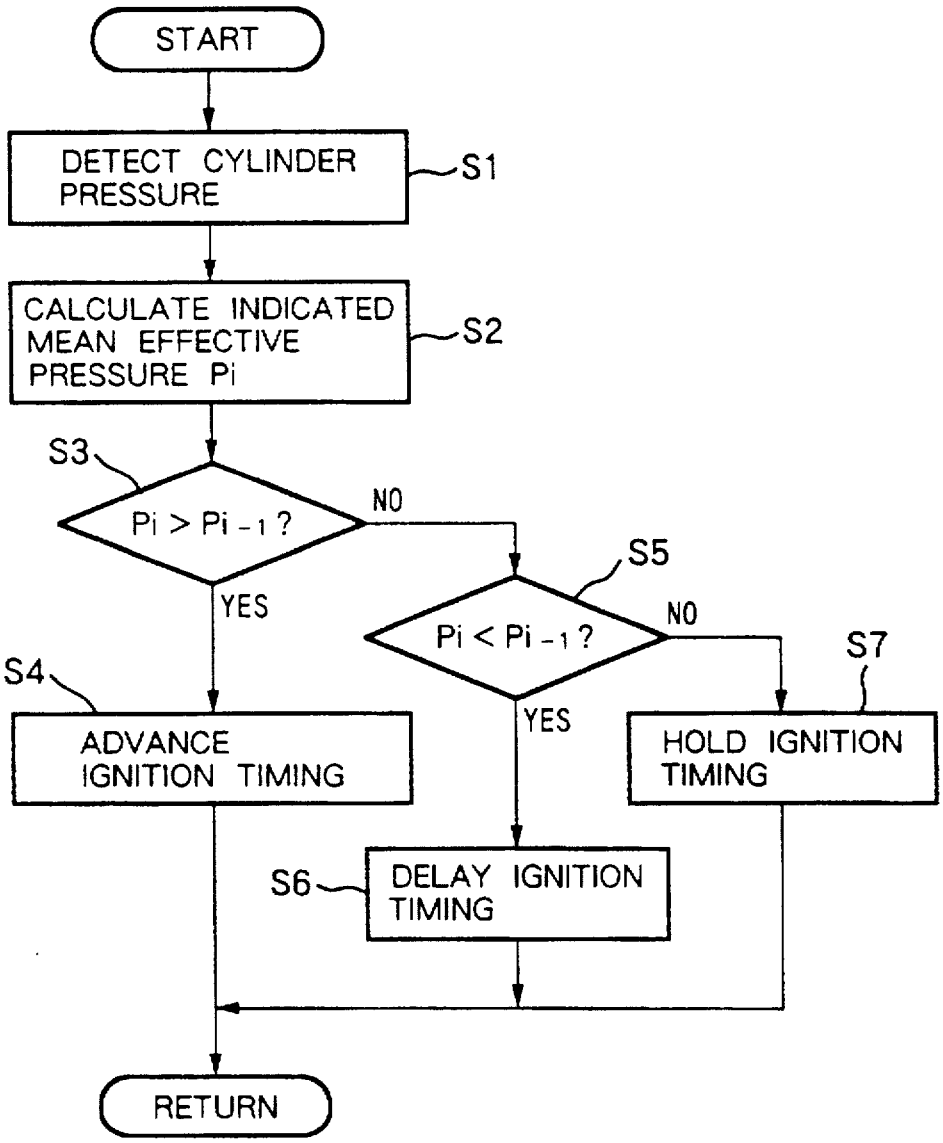
FIG. 2 is a flow chart showing a first embodiment of the method and apparatus for controlling the ignition timing of an internal combustion engine according to the present invention.

A first embodiment for correcting and controlling the ignition timing will now be described with reference to a flow chart of FIG. 2. In the first embodiment as shown in the flow chart of FIG. 2, the control unit 11 is provided, as software, with the functions of means for calculating an indicated mean effective pressure, means for correcting the ignition timing and means for controlling the ignition timing.

In the flow chart of FIG. 2, first, a cylinder pressure P detected by the cylinder pressure sensor 16 is read at step 1 (designated as S1 in FIG. 2, hereinafter the same holds).

At step 2, an indicated mean effective pressure Pi is calculated based upon the detected cylinder pressure P.

Here, if the stroke volume is denoted by Vs, cylinder volume by V and the cylinder pressure P are sampled for every 1° of the crank angle, then, the indicated mean effective pressure Pi is calculated in compliance with, $$Pi = \frac{1}{Vs}\Sigma P\Delta V = \frac{1}{Vs}\left\{\frac{P_o+P_i}{2}(V_1-V_0)+\frac{P_1+P_2}{2}(V_2-V_1)+\ldots+\frac{P_{719}+P_{720}}{2}(V_{720}-V_{719})\right\}$$

Here, however, the integrated values of cylinder pressures over a predetermined crank angle range such as from TDC to ATDC 120° in the compression top dead center or an average value of cylinder pressures may be calculated as a value corresponding to the indicated mean effective pressure.

At step 3, the indicated mean effective pressure Pi calculated this time at step 2 is compared with an indicated mean effective pressure Pi-1 calculated one cycle before. When the indicated mean effective pressure Pi is becoming larger than one cycle before, the program proceeds to step 4 where the ignition timing (a value for correcting the basic ignition timing) is advanced by a predetermined angle.

When the indicated mean effective pressure Pi is increasing, therefore, the ignition timing is gradually advanced.

When an increase in the indicated mean effective pressure Pi is not discriminated at step 3, on the other hand, the program proceeds to step 5 where it is discriminated whether the indicated mean effective pressure Pi calculated this time at step 2 is smaller than the indicated mean effective pressure Pi-1 calculated one cycle before or not.

When a decrease in the indicate mean effective pressure Pi is discriminated, the program proceeds to step 6 where the ignition timing is delayed by a predetermined angle.

When a decrease in the indicated mean effective pressure Pi is not discriminated at step 5, on the other hand, it means that the indicated mean effective pressure Pi is remaining nearly constant. In this case, the program proceeds to step 7 where the previous value is held as the ignition timing (advanced value).

That is, when the indicated means effective pressure Pi tends to increase accompanying the advancement in the ignition timing, the ignition timing is gradually advanced. When the indicated mean effective pressure Pi starts decreasing, however, it is estimated that the ignition timing is too advanced passing over a point at which the indicated mean effective pressure Pi becomes maximal. Therefore, the ignition timing is delayed so as to be returned back to the point at which the indicated mean effective pressure Pi becomes maximal.

According to this constitution, even when the period for sampling the cylinder pressure P is relatively long, the ignition timing is corrected based upon a change in the indicated mean effective pressure Pi calculated based on a plurality of sampling values of the cylinder pressures P. Therefore, the ignition timing is so controlled as to obtain a maximum torque to a high precision.

A second embodiment for correcting and controlling the ignition timing will now be described with reference to a flow chart of FIG. 3. In the second embodiment as shown in the flow chart of FIG. 3, the control unit 11 is provided, as software, with the functions of means for calculating combustion ratio, means for correcting the ignition timing and means for controlling the ignition timing.

Figure 3:
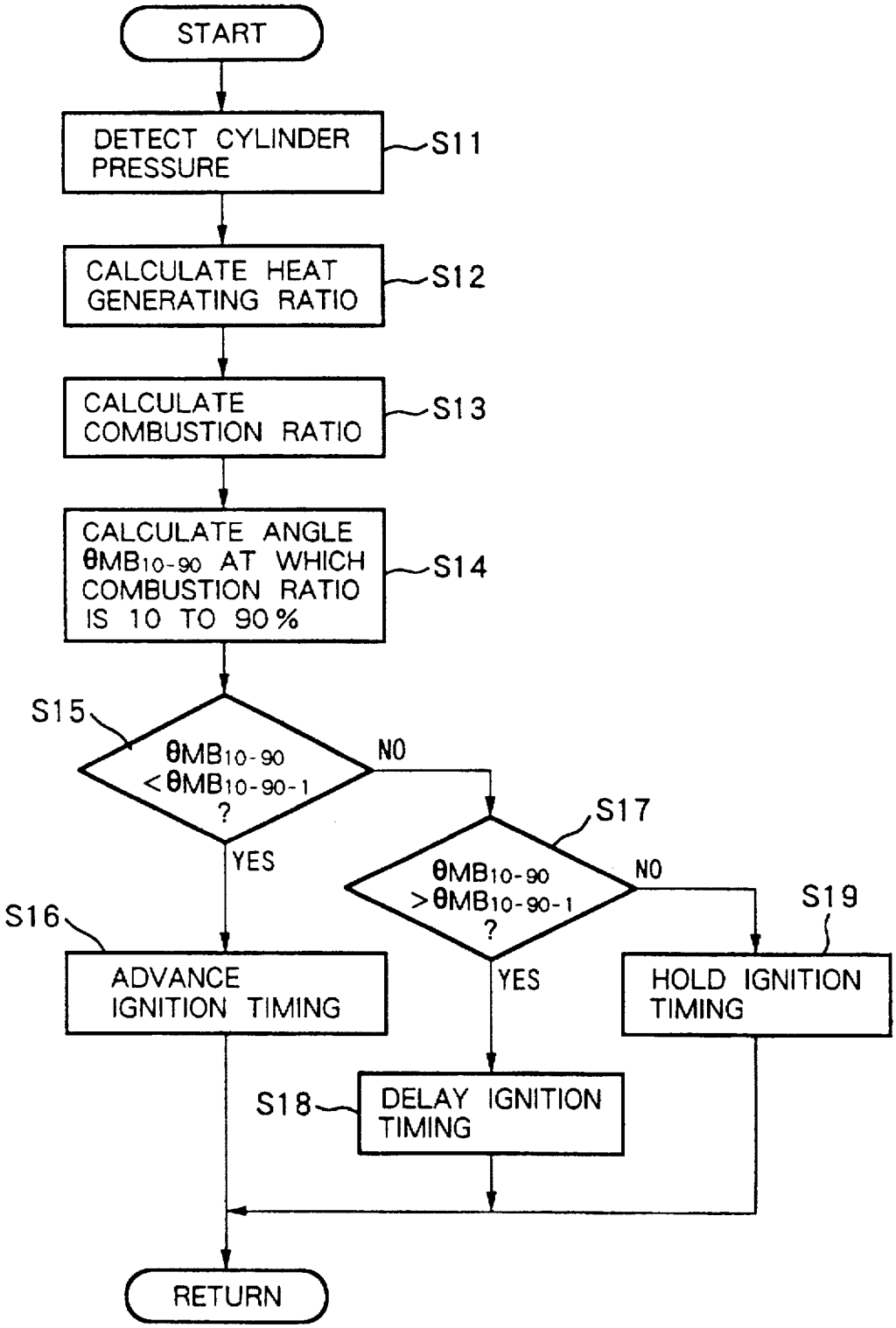
FIG. 3 is a flow chart showing a second embodiment of the method and apparatus for controlling the ignition timing of an internal combustion engine according to the present invention.

In the flow chart of FIG. 3, first, a cylinder pressure P detected by the cylinder pressure sensor 16 is read at step 11.

At step 12, a heat generating ratio qi (kcal/deg) is calculated based upon the cylinder pressure P detected in compliance with the following formula, $$qi = \frac{A}{k-1}\left\{ Vj\frac{dP}{d\theta} + kPj\frac{dV}{d\theta} \right\}$$

where A is a heat mechanical equivalent, k is a ratio of specific heat, Pj is a cylinder pressure, and Vj is a cylinder volume.

Figures 4A, 4B, 4C:
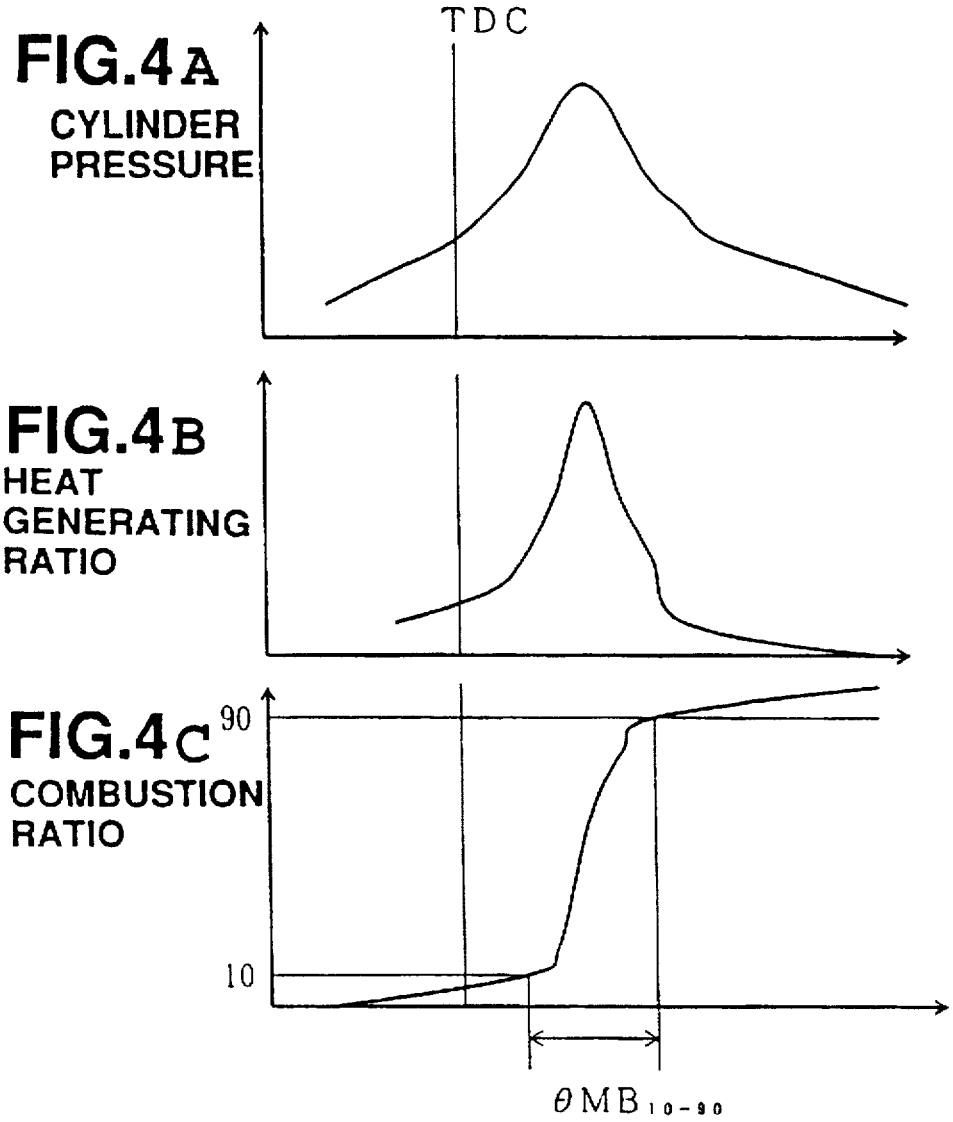
FIGS. 4A, 4B, and 4C are diagrams illustrating correlations among the cylinder pressure heat generating ratio and combustion ratio in an internal combustion engine.

At step 13, the combustion ratio is calculated based upon the calculated result of heat generating ratio qi. The combustion ratio is found as a heat generating ratio at every crank angle timing with respect to the total amount of heat generated with a point where the heat generating ratio becomes, for example, 0 as 100% combustion ratio (see FIG. 4).

Figure 5A:
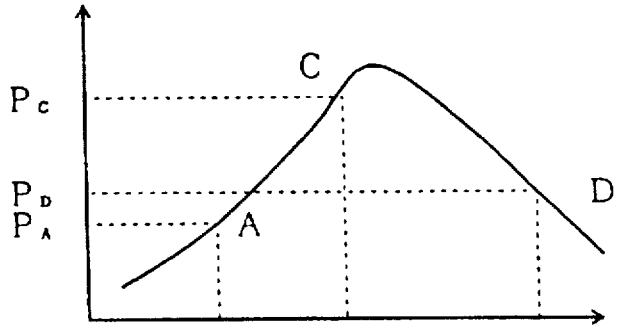
FIGS. 5A and 5B are diagrams illustrating a manner of estimatingly controlling the combustion ratio of an internal combustion engine.
Figure 5B:
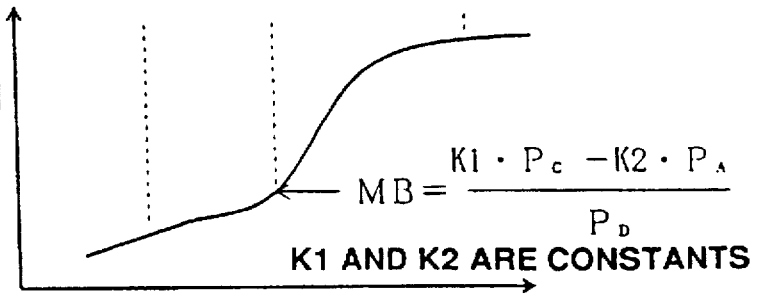

Instead of calculating the combustion ratio based upon the calculated result of the heat generating ratio qi, it is also possible as shown in FIG. 5 to estimate the combustion ratio at any desired crank angle timing from the cylinder pressures P at three or more points including at least the above crank angle timing.

At step 14, a crank angle $\theta MB_{10\text{-}90}$ corresponding to a predetermined range (e.g., 10 to 90%) of the combustion ratio is found.

At step 15, it is discriminated whether the latest value $\theta MB_{10\text{-}90}$ is smaller than the crank angle $\theta MB_{10\text{-}90\text{-}1}$ of one cycle before or not.

When the crank angle $\theta MB_{10\text{-}90}$ tends to decrease, the program proceeds to step 16 where the ignition timing is advanced by a predetermined angle.

When it is discriminated at step 15 that the crank angle $\theta MB_{10\text{-}90}$ is not decreasing, the program proceeds to step 17 where it is discriminated whether the latest value $\theta MB_{10\text{-}90}$ is larger than the crank angle $\theta MB_{10\text{-}90\text{-}1}$ of one cycle before or not.

When it is discriminated that the crank angle $\theta MB_{10\text{-}90}$ is increasing, the program proceeds to step 18 where the ignition timing is delayed by a predetermined angle.

When it is discriminated at step 17 that the crank angle $\theta MB_{10\text{-}90}$ is not increasing, i.e., when the crank angle $\theta MB_{10\text{-}90}$ remains nearly constant, the program proceeds to step 19 where the ignition timing (advanced value) of the previous time is held.

That is, the ignition timing is feedback corrected so that the crank angle $\theta MB_{10\text{-}90}$ is most narrowed and is so controlled as to obtain a maximum torque. Even in this case, the ignition timing is controlled based upon a change in the cylinder pressure P in one cycle. Therefore, a required precision is maintained even when the period of sampling the cylinder pressure P is relatively long compared with when the ignition timing is controlled based upon a moment at which a peak pressure P is produced in the cylinder.

Next, a third embodiment for correcting and controlling the ignition timing will be described with reference to a flow chart of FIG. 6. In the third embodiment as shown in the flow chart of FIG. 6, the control unit 11 is provided, as software, with the functions of means for calculating the combustion ratio, means for correcting the ignition timing and means for controlling the ignition timing.

Figure 6:
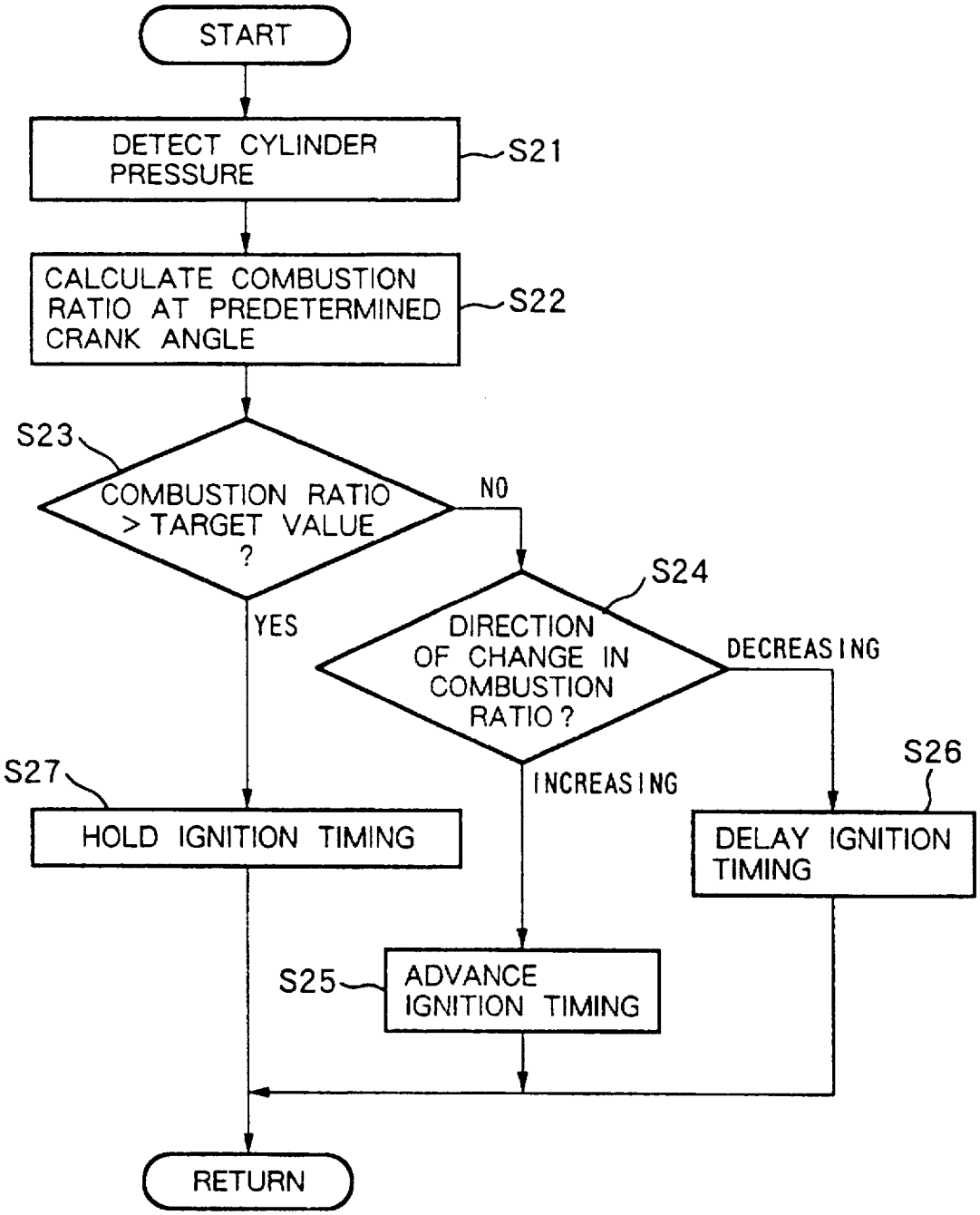
FIG. 6 is a flow chart showing a third embodiment of the method and apparatus for controlling the ignition timing of an internal combustion engine according to the present invention.

In the flow chart of FIG. 6, a cylinder pressure P detected by the cylinder pressure sensor 16 is read at step 21.

At step 22, a combustion ratio at a predetermined crank angle timing is estimated based on the cylinder pressures at three points including the predetermined crank angle timing (see FIG. 5).

At step 23, it is discriminated whether the combustion ratio at the predetermined crank angle timing is exceeding the target value or not.

When the combustion ratio is not exceeding the target value, the program proceeds to step 24 where the direction of change in the combustion ratio at the predetermined crank angle timing is discriminated.

Here, when the combustion ratio is increasing, the program proceeds to step 25 where the ignition timing is advanced by a predetermined angle. When the combustion ratio is decreasing, on the other hand, the program proceeds to step 26 where the ignition timing is delayed by a predetermined angle.

The ignition timing is advanced or delayed so that the combustion ratio at the predetermined crank angle timing is increased as much as possible. When it is discriminated at step 23 that the combustion ratio has exceeded the target value, the program proceeds to step 27 where the ignition timing (advanced value) of up to the previous time is held.

As described above, the ignition timing is controlled relying only upon the cylinder pressures at crank angle timing at three points. Thus, the ignition timing can be easily controlled.

We claim:

1. An apparatus for controlling the ignition timing of an internal combustion engine:

cylinder pressure detection means for detecting the cylinder pressure of the engine;

combustion ratio calculation means for calculating the combustion ratio of the engine based upon the cylinder pressure detected by said cylinder pressure detection means;

ignition timing correction means for delaying or advancing the ignition timing so that characteristics of a change in the combustion ratio calculated by said combustion ratio calculation means comply with a target state; and ignition timing control means for controlling the ignition timing at an ignition plug based upon the ignition timing corrected by said ignition timing correction means.

2. An apparatus for controlling the ignition timing of an internal combustion engine according to claim 1, wherein said combustion ratio calculation means calculates the heat generating ratio for every crank angle as a combustion ratio for the total amount of heat generated.

3. An apparatus for controlling the ignition timing of an internal combustion engine according to claim 1, wherein said ignition timing correction means delays or advances the ignition timing so that a crank angle corresponding to a predetermined range of said combustion ratio calculated by said combustion ratio calculation means becomes minimal.

4. An apparatus for controlling the ignition timing of an internal combustion engine according to claim 1, wherein said ignition timing correction means delays or advances the ignition timing so that said combustion ratio calculated by said combustion ratio calculation means at a preset crank angle becomes equal to or larger than a desired value.

5. An apparatus for controlling the ignition timing of an internal combustion engine comprising:

cylinder pressure detection means for detecting the cylinder pressure of the engine;

heat generating ratio calculation means for calculating a heat generating ratio based on the cylinder pressure detected by said cylinder pressure detection means;

combustion ratio calculation means for calculating the combustion ratio of the engine based upon the heat generating ratio calculated by said heat generating ratio calculation means;

crank angle calculation means for calculating a crank angle corresponding to a predetermined range of said combustion ratio calculated by said combustion ratio calculation means; and ignition timing correction means for delaying or advancing the ignition timing so that the crank angle calculated by said crank angle calculation means becomes minimal.

6. An apparatus for controlling the ignition timing of an internal combustion engine comprising:

cylinder pressure detection means for detecting the cylinder pressure of the engine;

combustion ratio estimation means for estimating the combustion ratio at one of three preset crank angles based on the cylinder pressures detected at the respective three crank angles by said cylinder pressure detection means; and ignition timing correction means for delaying or advancing the ignition timing so that the combustion ratio estimated by said combustion ratio estimation means becomes equal to or greater than a target value.

7. A method of controlling the ignition timing of an internal combustion engine, comprising the steps of:

calculating a heat generating ratio based on a cylinder pressure;

calculating a combustion ratio based on the heat generating ratio;

calculating a crank angle corresponding to a predetermined range of combustion ratio; and varying the ignition timing so that the crank angle corresponding to the predetermined range of combustion ratio is minimized.

8. A method of controlling the ignition timing of an internal combustion engine, comprising the steps of:

detecting the cylinder pressures of the engine at a plurality of preset crank angles;

estimating the combustion ratio of one of the plurality of crank angles based on the cylinder pressure detected at the plurality of crank angles; and varying the ignition timing so that the estimated combustion ratio becomes equal to or greater than a target value.

9. A method of controlling the ignition timing of an internal combustion engine comprising the steps of:

detecting a cylinder pressure of the engine;

calculating the combustion ratio based upon the results of the detected cylinder pressure; and advancing or delaying the ignition timing so that a change in combustion ratio complies with a target state.

10. A method of controlling the ignition timing of an internal combustion engine according to claim 9, wherein the step of calculating said combustion ratio is carried out by determining a heat generating ratio for each crank angle of a predetermined crank angle range, with respect to a total amount of heat generated in said predetermined crank angle range.

11. A method of controlling the ignition timing of an internal combustion engine according to claim 9, wherein said step of advancing or delaying the ignition timing corresponds to a predetermined range wherein the combustion ratio becomes minimal.

12. A method of controlling the ignition timing of an internal combustion engine according to claim 9, wherein said step of advancing or delaying the ignition timing is effected so that the combustion ratio at a preset crank angle becomes equal to or larger than a target value.

13. A method of controlling the ignition timing of an internal combustion engine according to claim 9, wherein said combustion ratio is derived using the equation:

$$qi = \frac{A}{k-1}\left\{ Vj\frac{dp}{d\theta} + Pj\frac{dv}{d\theta} \right\}$$

wherein:

qi is the heat generating ratio;

P is the cylinder pressure;

A is a heat mechanical equivalent;

k is a specific heat ratio;

Pj is a cylinder pressure;

Vj is a cylinder volume.

* * * * *